United States Patent [19]

Verderio

[11] 4,096,923

[45] Jun. 27, 1978

[54] FIRE ESCAPE TO BE ATTACHED TO THE OUTSIDE OF A BUILDING

[76] Inventor: Giuseppe Verderio, via Padana Superiori 1, Gessate (Milan), Italy

[21] Appl. No.: 757,690

[22] Filed: Jan. 7, 1977

[30] Foreign Application Priority Data

Jan. 23, 1976 Italy ..... 19502 A/76

[51] Int. Cl.[2] ..... E04F 11/00

[52] U.S. Cl. ..... 182/83; 52/187

[58] Field of Search ..... 182/48, 83; 52/187, 52/182

[56] References Cited

U.S. PATENT DOCUMENTS

| | | | |
|---|---|---|---|
| 931,031 | 8/1909 | Brooks | 182/83 |
| 1,726,133 | 8/1929 | Wilson | 52/187 |
| 3,686,806 | 8/1972 | Verderio | 52/187 |

FOREIGN PATENT DOCUMENTS

| | | | |
|---|---|---|---|
| 1,579,200 | 7/1969 | France | 182/83 |

*Primary Examiner*—Reinaldo P. Machado

*Attorney, Agent, or Firm*—Kirschstein, Kirschstein, Ottinger & Cobrin

[57] ABSTRACT

It is well known that large buildings, for example hospitals, apartment buildings, hotels, schools, industrial buildings, theatres, etc. shall be provided with a fire escape attached to the outside of the building, on a facade having a safety outlet on each single floor. For the purpose, naturally, to allow the occupants of the building, in case of fire or similar, to leave the inside of the building in danger through the said safety outlets then using the fire escape.

Numerous kinds of fire escapes are already known without, however, satisfying all the requisites and exigencies required.

3 Claims, 2 Drawing Figures

FIRE ESCAPE TO BE ATTACHED TO THE OUTSIDE OF A BUILDING

BACKGROUND AND SUMMARY OF THE INVENTION

The purpose of this invention is a fire escape without the drawbacks characterizing the preceding state of the art, in particular a fire escape allowing the free access to the fire escape from the safety outlets on the single floors, allowing at the same time to reach the underlying floors following a regular staircase without sharp changes of direction and using steps having a comfortable rise and width. It is a further object of third invention to propose a fire escape made of prefabricated elements, unit composed and suitable without substantial modifications to different heights of the single storeys and of the buildings. An ulterior object of this invention is a fire escape whose access and outlet are always in the best possible position for allowing the rapid and unhindered evacuation of the fire escape in the event of danger. Finally, the here proposed fire escape is characterized by a surprising stability, by the possibility to erect it independently of the building, by requiring a minimum of base space.

The said objects and purposes are obtained according to this invention by a fire escape by having a platform interlocked with the safety outlet at an upper floor connected to a platform interlocked with the safety outlet at a lower floor by means of two supporting columns running along the whole height of the building and spaced from the facing and spaced among themselves, with the first column supporting the winders of a first turn of a spiral stair case, these winders being interposed with a series of straight steps supported by the first and/or the second column to reach a second group of winders forming another half turn of the spiral stair case supported by the second column and leading to the lower platform.

The here proposed invention uses for a fire escape of the here mentioned type all the advantages part of a classical spiral stair case, with the possibility, however, to adapt it freely to various heights of the floors of the building without having to change the ideal height of the single steps and allowing, in particular, the rapid access to the fire escape, and at the same time, from more than one safety outlet, one above the other one, but all in the same vertical plane.

BRIEF DESCRIPTION OF THE DRAWINGS

The object conceived according to this invention will now be described more in detail for an embodiment thereof, without being limited thereto, given only by way of example, and on hand of the accompanying drawings in which.

DESCRIPTION OF THE PREFERRED EMBODIMENT

Figure 1:
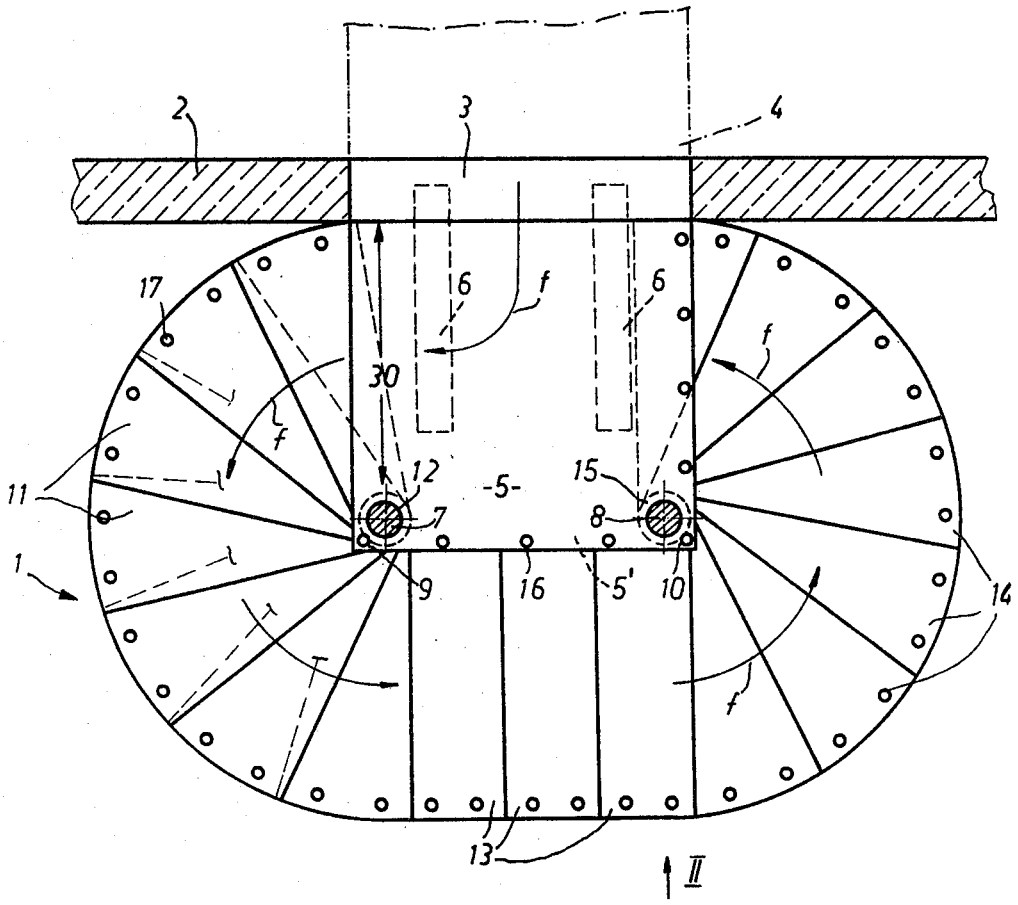
FIG. 1 is a horizontal section through the fire escape along line I—I of FIG. 2.

As shown in FIG. 1, the fire escape indicated by 1 is arranged parallel to the front face 2 of a building, at the safety outlets 3 of the single floors lying all in the same vertical line, and connected to safety corridors 4 one to each floor.

Each safety outlet 3 is connected to a projecting platform 5 supported for example by two projecting brackets 6 fixed to the front 2.

Each platform 5 is still further supported by two columns 7 and 8 resting on foundations (not shown) provided at the foot of the building. The columns 7 and 8 are fixed at the angles 9 and 10 of the platform 5, spaced from the building 2; at the same time the said columns run parallel one to the other along the whole height of the building.

When to be used the fire escape 1 serves to descend from an upper platform 5 to a lower platform 5', as indicated by the arrow *f*.

Column 7 locked in the shown embodiment (FIG. 1) to the outlet 30 at the platform 5, carries also the steps 11 of a spiral staircase completing in direction of the arrow *f* a turn equal to 180°. The steps 11 are carried by the column 7 and supported in addition by spacer sleeves 12 inserted on the column 7 each spacer between two steps 11.

At the end of the series of steps or winders 11, in direction of the arrow *f*, we find a series of straight steps 13 supported in part by column 7, in part by column 8. These steps 13 are then followed by a further series of steps or winders 14 in the form of a spiral stair and in the same manner as described for the winders 11, supported by the column 8 and again separated and supported by spacer sleeves 15 seated on the column 8, one between each pair of winders. The platform 5 is provided with a railing 16, the same as the steps 11, 13, 14, with the railing schematically indicated by the uprights 17.

Figure 2:
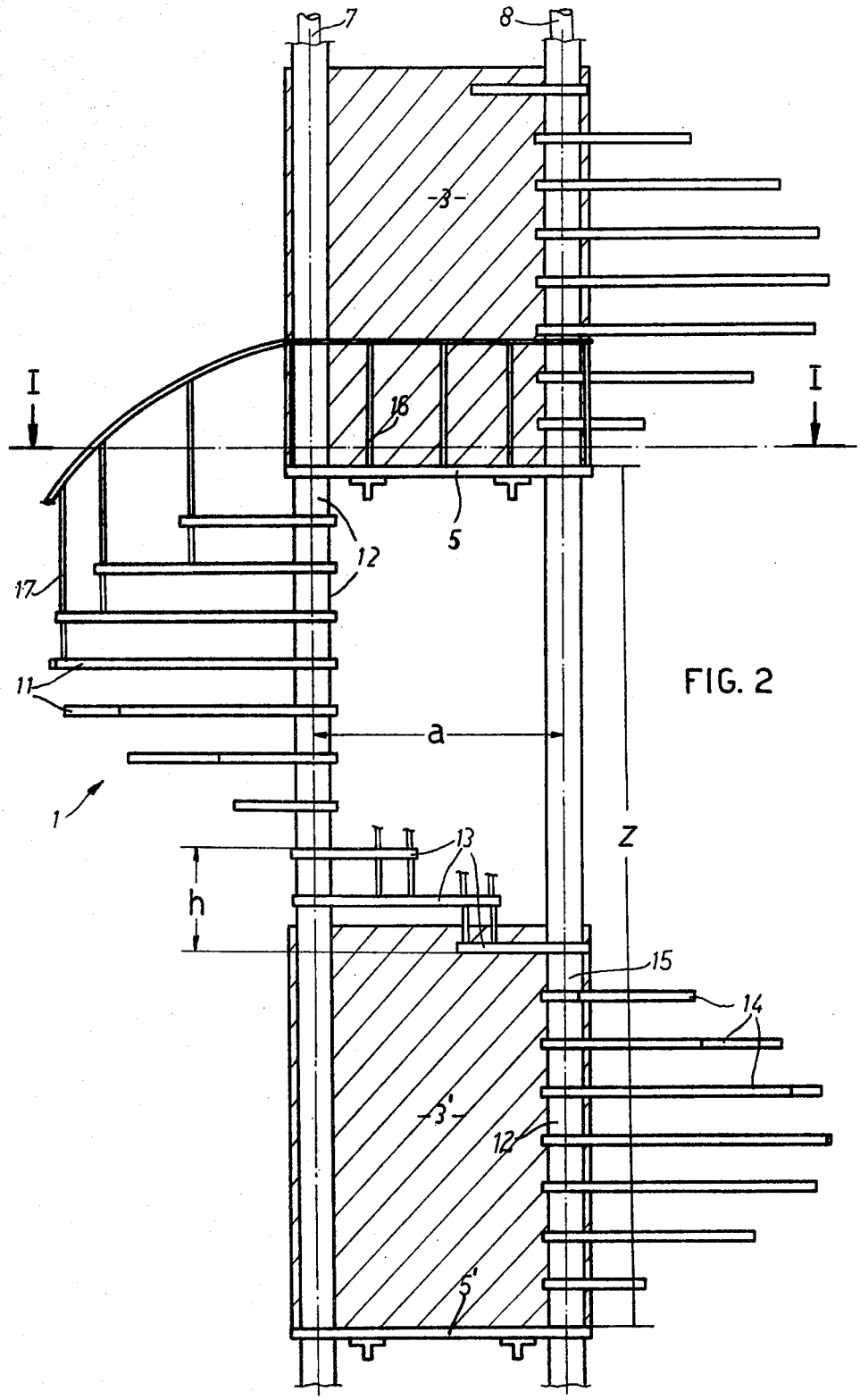
FIG. 2 is an elevation of the spiral stair seen along arrow II in FIG. 1.

FIG. 2 shows the fire escape 11 between the two safety outlets 3 and 3' of two adjacent floors. The two supporting columns 7 and 8, as shown to be parallel and support by means of the sleeves 12 and 15 both the platform 5 and platform 5', as well as the steps and winders 11, 13, 14 between the two platforms.

FIG. 2 also shows that the safety outlets 3, 3', in dashed outlines to distinguish them, are not at all obstacled by the supporting means or by the steps and winders of the stair and allow thus the quick, safe and free use of the fire escape 1 in the event of danger. To keep the drawings clear the railings which naturally are provided, are indicated only schematically at 16 for the platform 5 and at 17 for part of the steps.

A further advantage is that the straight steps 13 have a double width and can thus be anchored one to the other and to the respective columns 7 and 8, thus confering a major stability to the straight stretch. To allow the fire escape 1 to be adaptable to different heights (*z*) of the single floors, it is sufficient to increase or to diminish the distance (*a*) between the columns 7 and 8, with the therefrom ensuing possibility of inserting a greater number of steps 13 and thus varying the height (*h*) without having to modify the rise or the number of the winders 11, 14. This allows to realise fire escapes using modular prefabricated elements easily adapted to different heights in different buildings (from about 2.80 m to 4.20 m) maintaining at the same time the ideal rise (180–200 m) and width of the steps and winders, modifying only the distance (*a*) between the columns and therewith the number of straight steps 13 and the parameter (*h*).

What we claim is:

1. A fire escape attached in parallel position to the outside of a face of a building having vertically aligned safety outlets of like widths therein, said fire escaping comprising:

A. a different horizontal platform extending away from the building at the sill of each safety outlet, i. the widths of the platforms being substantially equal to the widths of the associated outlets, B. two supporting columns the lower ends of which are located adjacent and spaced outwardly from the base of the building, i. said columns extending the whole height of the building, ii. said columns being located adjacent the outside corners of the platform and supporting the same, iii. one column being substantially horizontally registered with one vertically registered set of vertical edges of the safety outlets and the other column being substantially horizontally registered with the other vertically registered set of vertical edges of the safety outlets whereby the columns are mutually spaced apart in a horizontal direction parallel to said face of the building by substantially the width of the safety outlets, C. two sets of half-turn spiral stair winders i. each set being associated with and supported by a different column, and D. plural vertically registered series of straight steps, i. each series of straight steps of the plural series being spaced away from the building and parallel to said face of the building and being located vertically midway between safety outlets, E. the two sets of half-turn spiral stair winders, the plural series of straight steps and the platforms being interconnected in a sequence such that i. a descending half-turn spiral stair winder of one set leads from a higher horizontal platform down and around to a series of descending straight steps which leads to a descending half-turn spiral stair winder of the other set which leads down and around to the next lower horizontal platform which leads to the next lower descending half-turn spiral stair winder of the one set in a repeating arrangement that terminates adjacent the base of the building, F. whereby a building occupant in the event of fire when leaving the building by the fire escape exits through a safety outlet and then continuously moves down and around the fire escape with a minimum change in direction which occurs for only a short span at the platforms and the series of straight steps so that the building occupants can descend the fire escape rapidly and without hindrance.

2. A fire escape according to claim 1, in which the steps and winders are supported by the columns by means of the interposition of spacer sleeves seated between the steps and winders and inserted on and blocked onto the respective columns.

3. A fire escape according to claim 1, in which some of the straight steps have twice the width of the other one or more, thus allowing to be fixed the one to the other or to the supporting columns or both.

* * * * *